US012385495B2

(12) United States Patent
He et al.

(10) Patent No.: US 12,385,495 B2
(45) Date of Patent: Aug. 12, 2025

(54) DUAL FAN WITH INCREASED AIR FLOW

(71) Applicant: DELL PRODUCTS L.P., Round Rock, TX (US)

(72) Inventors: Qinghong He, Austin, TX (US); Susan McCartt, Austin, TX (US); Kelly Miller, Austin, TX (US); Travis North, Cedar Park, TX (US)

(73) Assignee: Dell Products L.P., Round Rock, TX (US)

( * ) Notice: Subject to any disclaimer, the term of this patent is extended or adjusted under 35 U.S.C. 154(b) by 17 days.

(21) Appl. No.: 18/420,314

(22) Filed: Jan. 23, 2024

(65) Prior Publication Data

US 2025/0237225 A1 Jul. 24, 2025

(51) Int. Cl.

| | |
|---|---|
| ***F04D 25/16*** | (2006.01) |
| ***F04D 19/00*** | (2006.01) |
| ***F04D 29/52*** | (2006.01) |

(52) U.S. Cl.
CPC ..... *F04D 25/166* (2013.01); *F04D 19/002* (2013.01); *F04D 29/522* (2013.01)

(58) Field of Classification Search
CPC ..... F04D 25/166; F04D 19/002; F04D 29/522
See application file for complete search history.

(56) References Cited

U.S. PATENT DOCUMENTS

| | | | |
|---|---|---|---|
| 9,280,179 | B2 | 3/2016 | Morrison et al. |
| 10,416,734 | B2 | 9/2019 | Casparian et al. |

*Primary Examiner* — Aaron R Eastman
(74) *Attorney, Agent, or Firm* — Larson Newman, LLP

(57) ABSTRACT

A dual fan system includes a first fan that produces a first airflow, and a second fan that produces a second airflow. An air duct includes first and second nozzles, and first and second channels. The first channel directs the first airflow into an area between the first and second nozzles. The second channel directs the second airflow into the area between the first and second nozzles. The first and second airflows combine in the second nozzle to create an output airflow.

20 Claims, 6 Drawing Sheets

DUAL FAN WITH INCREASED AIR FLOW

FIELD OF THE DISCLOSURE

The present disclosure generally relates to information handling systems, and more particularly relates to dual fan system for the information handling system.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus, information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems. Information handling systems can also implement various virtualized architectures. Data and voice communications among information handling systems may be via networks that are wired, wireless, or some combination.

SUMMARY

A dual fan system includes a first fan that may produce a first airflow, and a second fan may produce a second airflow. An air duct includes first and second nozzles, and first and second channels. The first channel is in physical communication with an outlet of the first fan. The first channel may direct the first airflow into an area between the first and second nozzles. The second channel is in physical communication with an outlet of the second fan. The second channel may direct the second airflow into the area between the first and second nozzles. The first and second airflows combine together in the second nozzle to create an output airflow.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings and is provided to assist in describing the teachings. This focus should not be interpreted as a limitation on the scope or applicability of the teachings.

Figure 1:
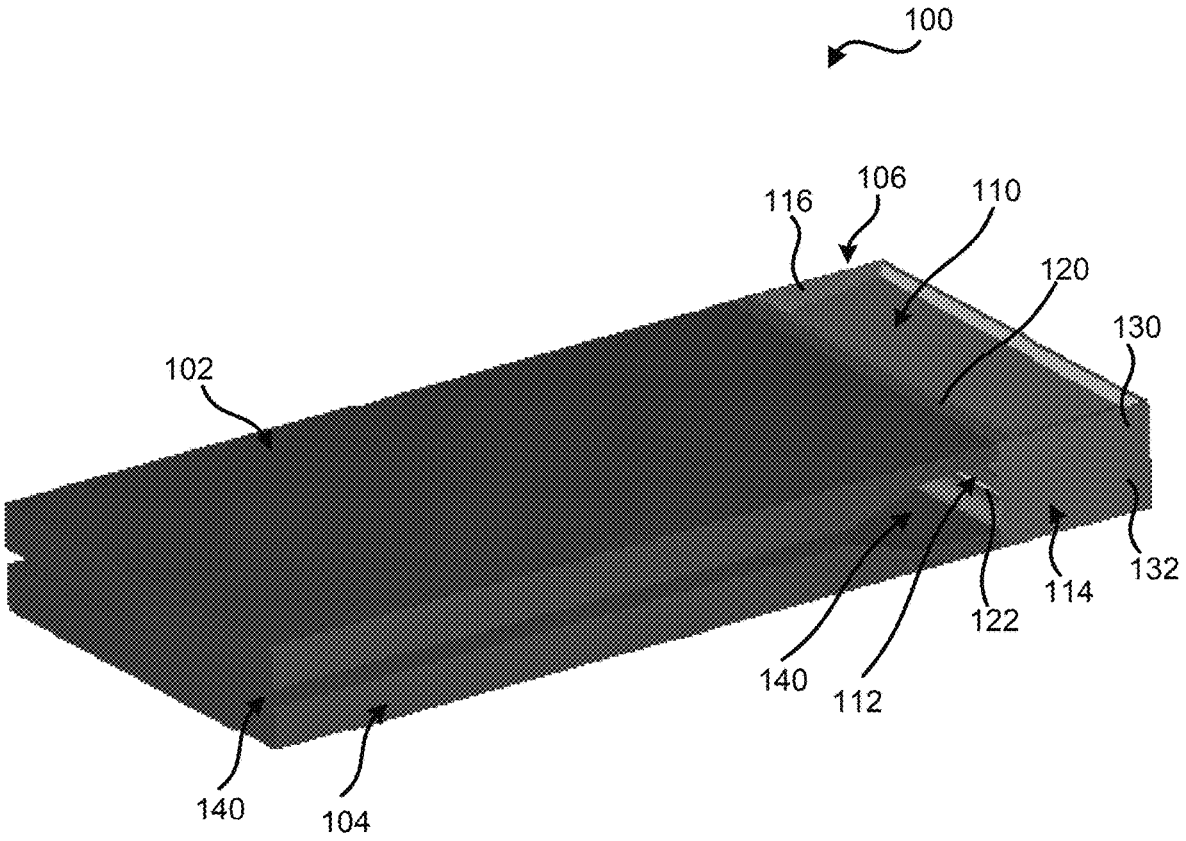
FIGS. 1 and 2 are perspective views of a dual fan system for an information handling system according to at least one embodiment of the present disclosure.
Figure 2:
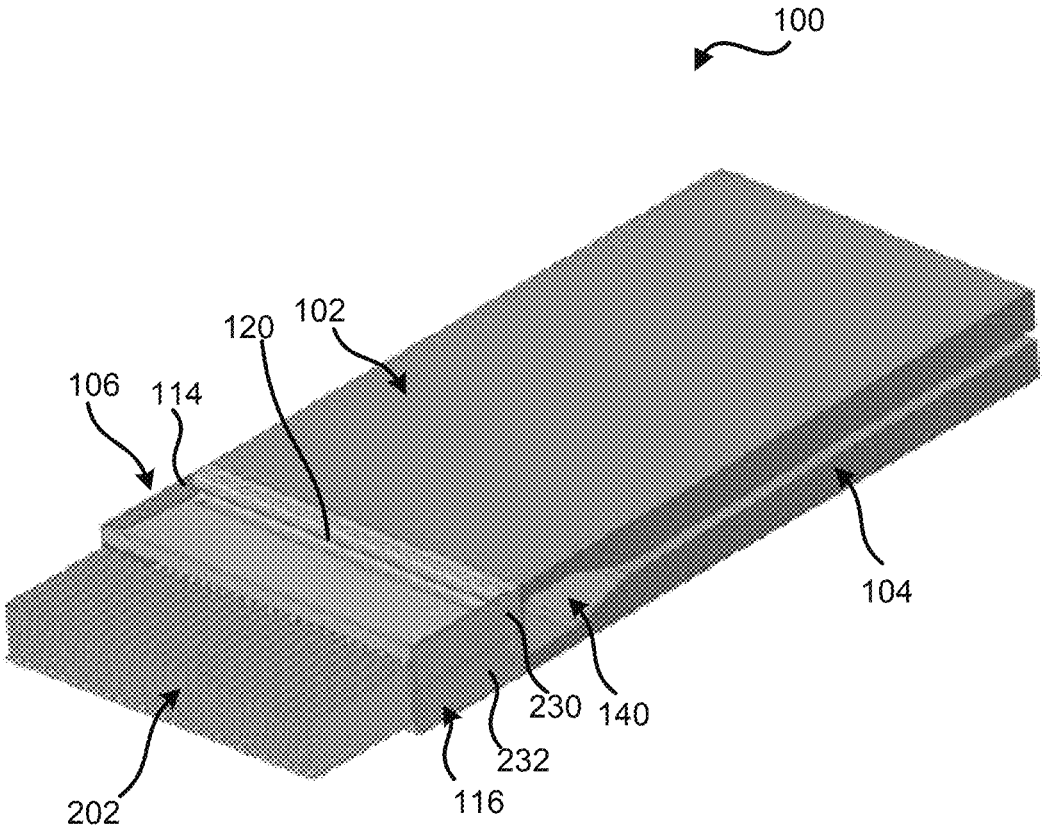

FIGS. 1 and 2 illustrate a dual fan system 100 for an information handling system according to at least one embodiment of the present disclosure. For purposes of this disclosure, an information handling system can include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (such as a desktop or laptop), tablet computer, mobile device (such as a personal digital assistant (PDA) or smart phone), server (such as a blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

Dual fan system 100 includes fans 102 and 104 and an air duct 106. Air duct 106 includes portions 110 and 112 and edges 114 and 116. Portions 110 and 112 include respective openings or slits 120 and 122. Each of side edges 114 and 116 may be a single edge or may be split into two different edges that correspond to portions 110 and 112 of air duct 106. For example, edge 114 may be formed from an edge 130 of portion 110 and an edge 132 of portion 112. Similarly, edge 116 may be formed from an edge 230 of portion 110 and an edge 232 of portion 112 as illustrated in FIG. 2. Dual fan system 100 may also include heat sink 202 illustrated in FIG. 2. Heat sink 202 may be a tight pitch fin array. Dual fan system 100 may include additional components without varying from the scope of this disclosure.

Each of fans 102 and 104 may be any suitable small profile fan, such as a piezo fan. In certain examples, fans 102 and 104 may include a high-pressure head or outlet, but the air flow may be at a low rate. In an example, the configuration of dual fan system 100 may increase the air flow rate and decrease the pressure of the air flow from fans 102 and 104. This configuration of dual fan system 100 may enable the dual fan system to provide thermal cooling within an information handling system, such as information handling system 600 of FIG. 6. In certain examples, heat sink 202 of dual fan system 100, illustrated in FIG. 2, may be placed in physical communication with a component of an information handling system, such as processor 602 or 604 in FIG. 6. In an example, the increase of the air flow rate and the decrease of the pressure of the air flow from fans 102 and 104 may improve heat dissipation for these components via heat sink 202 of FIG. 2.

In an example, fans 102 and 104 may be securely attached to air duct 106, such that the position of the fans are fixed within dual fan system 100. For example, the outlet of fan 102 may be securely mounted to portion 110 of air duct 106, and the outlet of fan 104 may be securely mounted to portion 112 of the air duct. Fans 102 and 104 may be stacked together with an air gap 140 between the fans. In an example, fans 102 and 104 may be connected to air duct 106 via their outlets but the fans may be in opposite orientations, such that substantially similar surfaces of the fans are facing each other as illustrated in FIG. 1.

Figure 3:
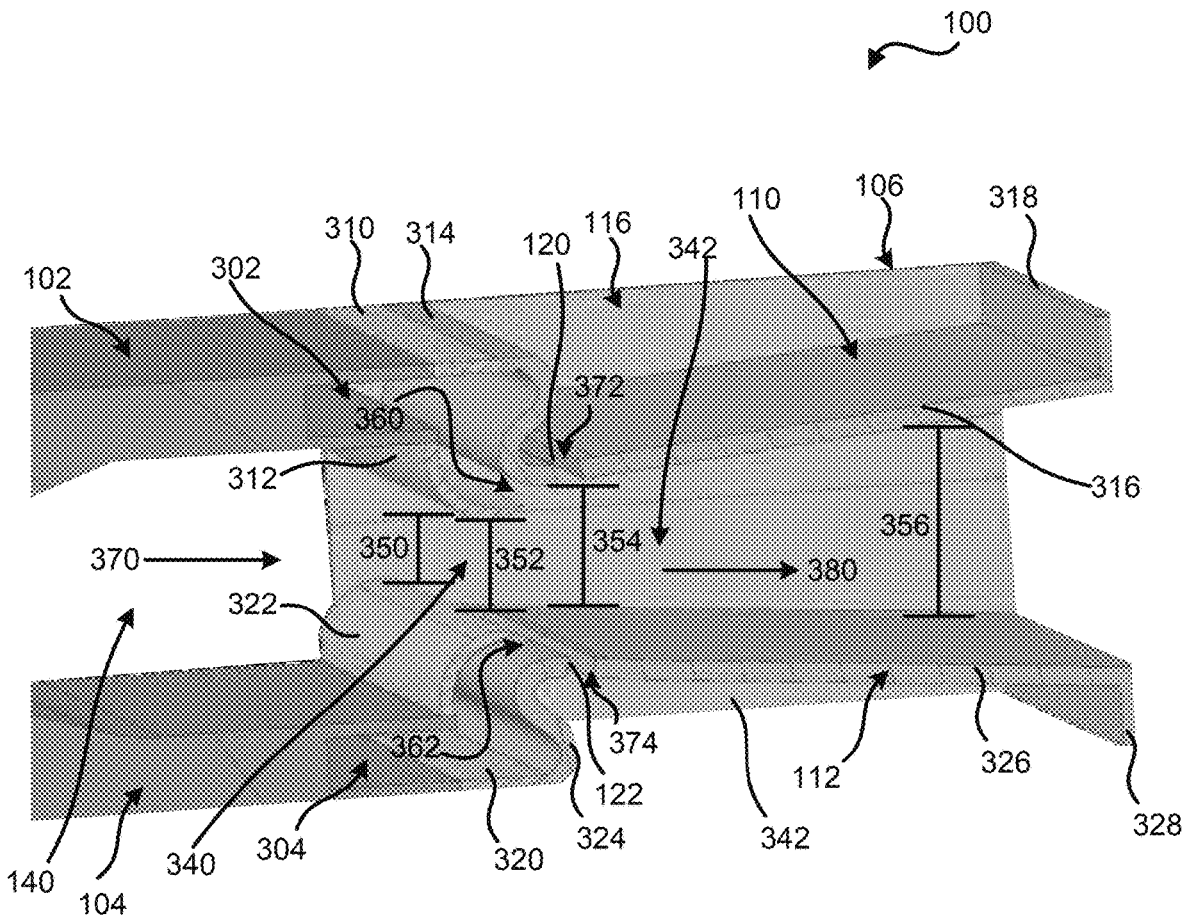
FIG. 3 is a cross-sectional view of a dual fan system according to at least one embodiment of the current disclosure.

FIG. 3 illustrates a cross-section of a portion of dual fan system 100 according to at least one embodiment of the current disclosure. Fan 102 includes an outlet 302 and fan 104 includes an outlet 304. Portion 110 includes a connection section 310, a curved section 312, an s section 314, a slope section 316, and a wall 318. Portion 112 includes a connection section 320, a curved section 322, an s section 324, a slope section 326, and a wall 328. Dual fan system 100 may include additional components without varying from the scope of this disclosure.

In an example, the different sections of portions of 110 and 112 form two air flow nozzles 340 and 342 within dual fan system 100. Nozzle 340 includes a neck 350 and an exit 352, and nozzle 342 includes a neck 354 and an exit 356. As illustrated in FIG. 3, neck 350 of nozzle 340 is narrower than exit 352 of the nozzle, such that the air flow rate or velocity increases through the nozzle as illustrated and described with respect to FIG. 4 below. Similarly, neck 354 of nozzle 342 is narrower than exit 356 of the nozzle, such that the air flow rate or velocity increases through the nozzle as illustrated and described with respect to FIG. 4 below. In certain examples, exit 354 of nozzle 340 may be located roughly in the area neck 354 of nozzle 342.

In certain examples, connection section 310 may provide a physical link between outlet 302 of fan 102 and s section 314 of air duct 106. Also, connection section 320 may provide a physical linking of outlet 304 of fan 104 to s section 324 of air duct 106. In an example, the air flow from fan 102 may travel through channel 360 and enter air duct 106 between nozzles 340 and 342. Similarly, the air flow from fan 104 may travel through channel 362 and enter air duct 106 between nozzles 340 and 342. In an example, channel 360 may have a narrow opening between curve section 312 and s section 314 and this narrow opening may increase the air flow velocity from fan 102. Similarly, channel 362 may have a narrow opening between curve section 322 and s section 324 and this narrow opening may increase the air flow velocity from fan 104.

In an example, an air flow may be pulled through gap 140 between fans 102 and 104 in the direction of arrow 370. This air flow may be pulled, in the direction of arrow 370, through gap 140 and into nozzle 340 via the combination of the high pressure of the air flow from fan 102 entering air duct 106 through channel 360 and the high pressure of the air flow from fan 104 entering the air duct through channel 362. In an example, the air flow pulled from gap 140 may increase an overall amount of air flow through air duct 106.

In certain examples, both opening 120 of portion 110 in air duct 106 and opening 122 of portion 112 may be located slightly in front of exit 352 of nozzle 340 and slightly behind neck 354 of nozzle 342. Based on both the location of opening 120 and the high pressure of the air flow from fan 102 entering air duct 106 through channel 360, an air flow may be pulled through the opening in the direction of arrows 372. Similarly, based on both the location of opening 122 and the high pressure of the air flow from fan 104 entering air duct 106 through channel 362, an air flow may be pulled through the opening in the direction of arrows 274. In an example, the air flows pulled through openings 120 and 122 may increase an overall amount of air flow through nozzle 342 of air duct 106 in the direction of arrow 380.

In an example, the high-pressure of the air flow from fans 102 and 104 entering air duct 106 may create a negative pressure with respect to the ambient air may be created at neck 350 of nozzle 340 and openings 120 and 122. This negative pressure may result from gap 140 and openings 120 and 122 all being open to ambient air and as a result additional air is pulled into the airflow stream through air duct 106. In an example, the negative pressure at openings 120 and 122 may reduce the pressure of the air flow from fans 102 and 104 entering air duct 106 generally in the area of exit 352 and neck 354. Thus, dual fan system 100 may provide a low pressure and high volume of air flow out of air duct 106 in the direction of arrow 380. This low pressure and high volume of air flow may provide cooling to an information handling system, such as information handling system 600 of FIG. 6. Additionally, heat sink 202, illustrated in FIG. 2, may provide additional thermal cooling within the information handling system.

Figure 4:
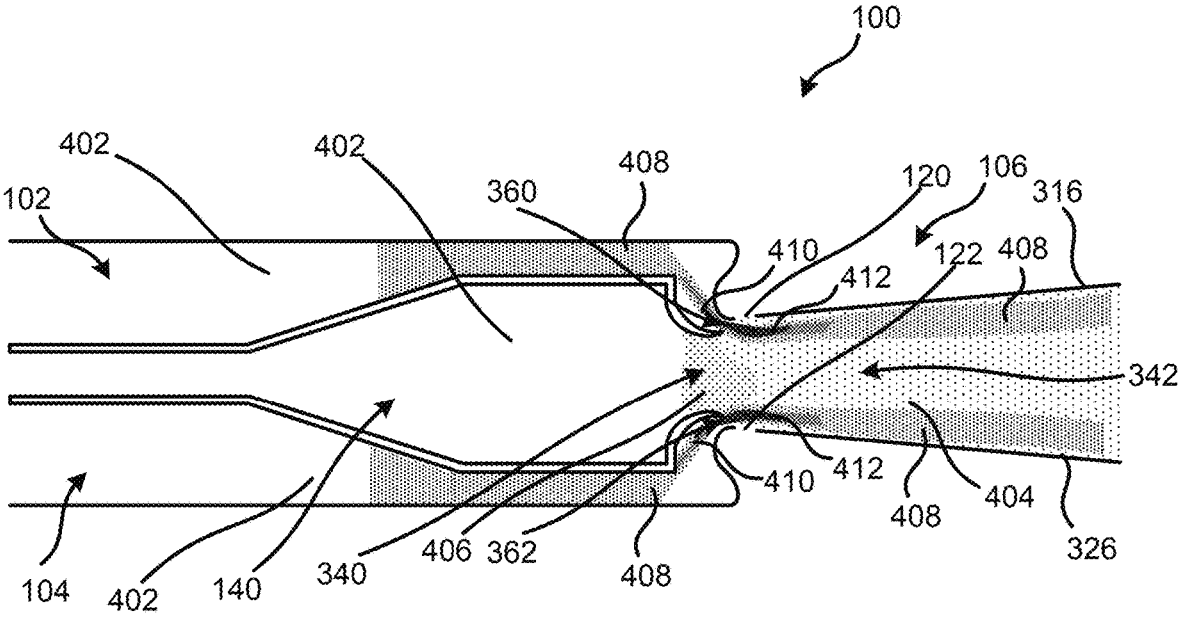
FIG. 4 is a cross-sectional view of a dual fan system with different air flow velocities at different regions of the dual fan system according to at least one embodiment of the current disclosure.

FIG. 4 illustrates a diagram of dual fan system 100 with different air flow velocities 402, 404, 406, 408, 410, and 412 at different regions of the dual fan system according to at least one embodiment of the current disclosure. In certain examples, the darker the shading of a region the higher velocity of the air flow in that region. As the reference number increases the air flow velocity also increases. For example, velocity level 402 is the lowest level and increases to level 404, then level 406, followed by level 408, then level 410, and level 412 is the highest velocity. Dual fan system 100 may include additional velocity level regions without varying from the scope of this disclosure.

As illustrated in FIG. 4, lowest velocity level 402 may be located within fans 102 and 104 and also within gap 140 between the fans. This lowest velocity level 402 in fans 102 and 104 may be based on the fans starting to generate air flows. In an example, gap 140 may be open to ambient air, such that the velocity level 402 within the gap is at a low level. In certain examples, as the air flows are generated within fans 102 and 104 the velocity of the air flow from the fans increases to velocity level 408. As illustrated in FIG. 4, the air flow velocity change from velocity level 402 to velocity level 408 may be a large increase because at the region of velocity level 408 fans 102 and 104 produce the respective air flows.

In an example, as the airflow from fan 102 travels through channel 360 the velocity of the airflow may increase. For example, the exit of channel 360 may be narrower than the rest of the channel, such that the velocity may increase as the airflow from fan 102 approaches the exit. As illustrated in FIG. 4, as the airflow from fan 102 approaches the exit of channel 360, the velocity of the airflow increases to velocity level 410 and then to velocity level 412 as the airflow is expelled from the channel. In an example, the velocity level of the airflow may decrease the further away from the exit of channel 360 the airflow travels. For example, as the airflow from fan 102 travels from the exit of channel 360 along slop section 316 and out of dual fan system 100, the velocity of the air flow may decrease from velocity level 412 to velocity level 410, and then to velocity level 408. In certain examples, additional air flow may be pulled through opening 120 to increase the amount of airflow provided from dual fan system 100.

In an example, as the airflow from fan 104 travels through channel 362 the velocity of the airflow may increase. For example, the exit of channel 362 may be narrower than the rest of the channel, such that the velocity may increase as the airflow from fan 104 approaches the exit. As illustrated in FIG. 4, as the airflow from fan 104 approaches the exit of channel 362, the velocity of the airflow increases to velocity level 410 and then to velocity level 412 as the airflow is expelled from the channel. In an example, the velocity level of the airflow may decrease the further away from the exit of channel 362 the airflow travels. For example, as the airflow from fan 104 travels from the exit of channel 362 along slop section 326 and out of dual fan system 100, the velocity of the air flow may decrease from velocity level 412 to velocity level 410, and then to velocity level 408. In an example, additional air flow may be pulled through opening 122 to increase the amount of airflow provided from dual fan system 100.

In certain examples, airflow may be pulled from within gap 140 between fans 102 and 104. In these situations, the airflow may have a velocity at velocity level 402 in a region located in front of air duct 106. When the airflow enters air duct 106, such as through nozzles 340 and 342, the velocity of the airflow from gap 140 may increase to velocity level 406. In an example, as the airflow from gap 140 continues to travel through air duct 106, the velocity of the airflow may decrease to velocity level 404. In certain examples, the airflow from gap 140, the airflow from opening 120, the airflow from opening 122, the airflow from fan 102, and the airflow from fan 104 may combine to provide a higher volume or amount of airflow from dual fan system 100 as compared to a single fan or fans without gap 140 and/or openings 120 and 122.

Figure 5:
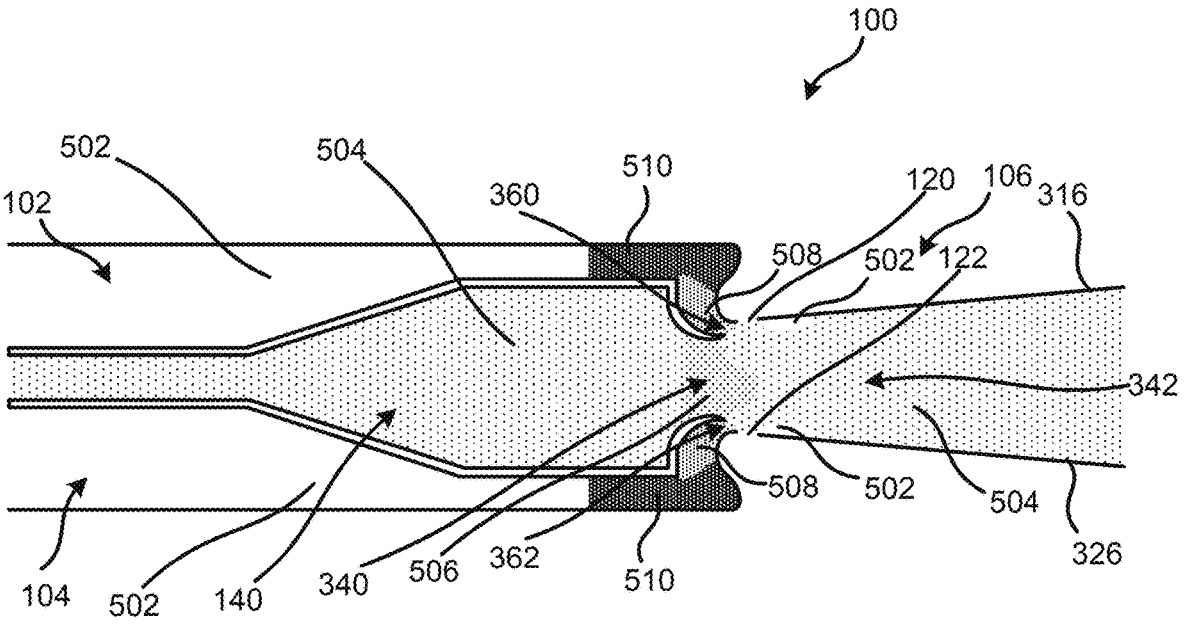
FIG. 5 is a cross-sectional view of a dual fan system with different air flow pressures at different regions of the dual fan system according to at least one embodiment of the current disclosure.

FIG. 5 illustrates a diagram of dual fan system 100 with different air flow pressures 502, 504, 506, 508, and 510 at different regions of the dual fan system according to at least one embodiment of the current disclosure. In certain examples, the darker the shading of a region the higher pressure of the air flow in that region. As the reference number increases the air flow pressure also increases. For example, pressure level 502 is the lowest level and increases to level 504, then level 506, followed by level 508, and then level 510 is the highest pressure. Dual fan system 100 may include additional pressure level regions without varying from the scope of this disclosure.

As illustrated in FIG. 5, lowest pressure level 502 may be located within fans 102 and 104. This lowest pressure level 502 in fans 102 and 104 may be based on the fans starting to generate air flows. In an example, gap 140 may be open to ambient air but an airflow within the gap may be pulled within air duct 106, such that the pressure level 504 within the gap is at a slightly higher level than within fans 102 and 104. In certain examples, as the air flows are generated within fans 102 and 104 the pressure of the air flow from the fans increases to the highest-pressure level 510. As illustrated in FIG. 5, the air flow pressure change from pressure level 502 to velocity level 510 may be a large increase because at the region of pressure level 510 fans 102 and 104 produce the respective air flows. The pressure level 510 is the highest because fans 102 and 104 are designed to produce airflows with high pressure levels.

In an example, as the airflow from fan 102 travels through channel 360 the pressure of the airflow may decrease. For example, the farther the airflow travels along channel 360, the pressure may decrease. As illustrated in FIG. 5, as the airflow from fan 102 approaches the exit of channel 360, the pressure of the airflow decreases to pressure level 508 and then to pressure level 504 as the airflow is met with a low-pressure region at opening 120. In an example, the pressure level at opening 120 may be pressure level 502, which in turn may be a negative pressure with respect to the ambient air on the other side of the opening. In an example, the negative pressure may cause airflow to enter air duct 106 at opening 120, and this mixture of airflows may cause an overall pressure of the airflow to be at pressure level 504. As the airflow from fan 102 travels from the exit of channel 360 along slop section 316 and out of dual fan system 100, the pressure of the air flow may be at pressure level 504. In certain examples, additional air flow may be pulled through opening 120 to increase the amount of airflow provided from dual fan system 100 at a lower pressure level than the airflow created at fan 102.

In an example, as the airflow from fan 104 travels through channel 362 the pressure of the airflow may decrease. For example, the farther the airflow travels along channel 362, the pressure may decrease. As illustrated in FIG. 5, as the airflow from fan 104 approaches the exit of channel 362, the pressure of the airflow decreases to pressure level 508 and then to pressure level 504 as the airflow is met with a low-pressure region at opening 122. In an example, the pressure level at opening 122 may be pressure level 502, which in turn may be a negative pressure with respect to the ambient air on the other side of the opening. In an example, the negative pressure may cause airflow to enter air duct 106 at opening 122, and this mixture of airflows may cause an overall pressure of the airflow to be at pressure level 504. As the airflow from fan 104 travels from the exit of channel 362 along slop section 326 and out of dual fan system 100, the pressure of the air flow may be at pressure level 504. In certain examples, additional air flow may be pulled through opening 122 to increase the amount of airflow provided from dual fan system 100 at a lower pressure level than the airflow created at fan 104.

In certain examples, airflow may be pulled from within gap 140 between fans 102 and 104. In these situations, the airflow may have a pressure at pressure level 506 in a region located in front of air duct 106. When the airflow enters air duct 106, such as through nozzles 340 and 342, the pressure of the airflow from gap 140 may increase to pressure level 506. In an example, as the airflow from gap 140 continues to travel through air duct 106, the pressure of the airflow may decrease to velocity level 504. In certain examples, the airflow from gap 140, the airflow from opening 120, the airflow from opening 122, the airflow from fan 102, and the airflow from fan 104 may combine to provide from dual fan system 100 an output airflow having a higher volume or amount and a lower pressure as compared to a single fan or fans without gap 140 and/or openings 120 and 122.

Figure 6:
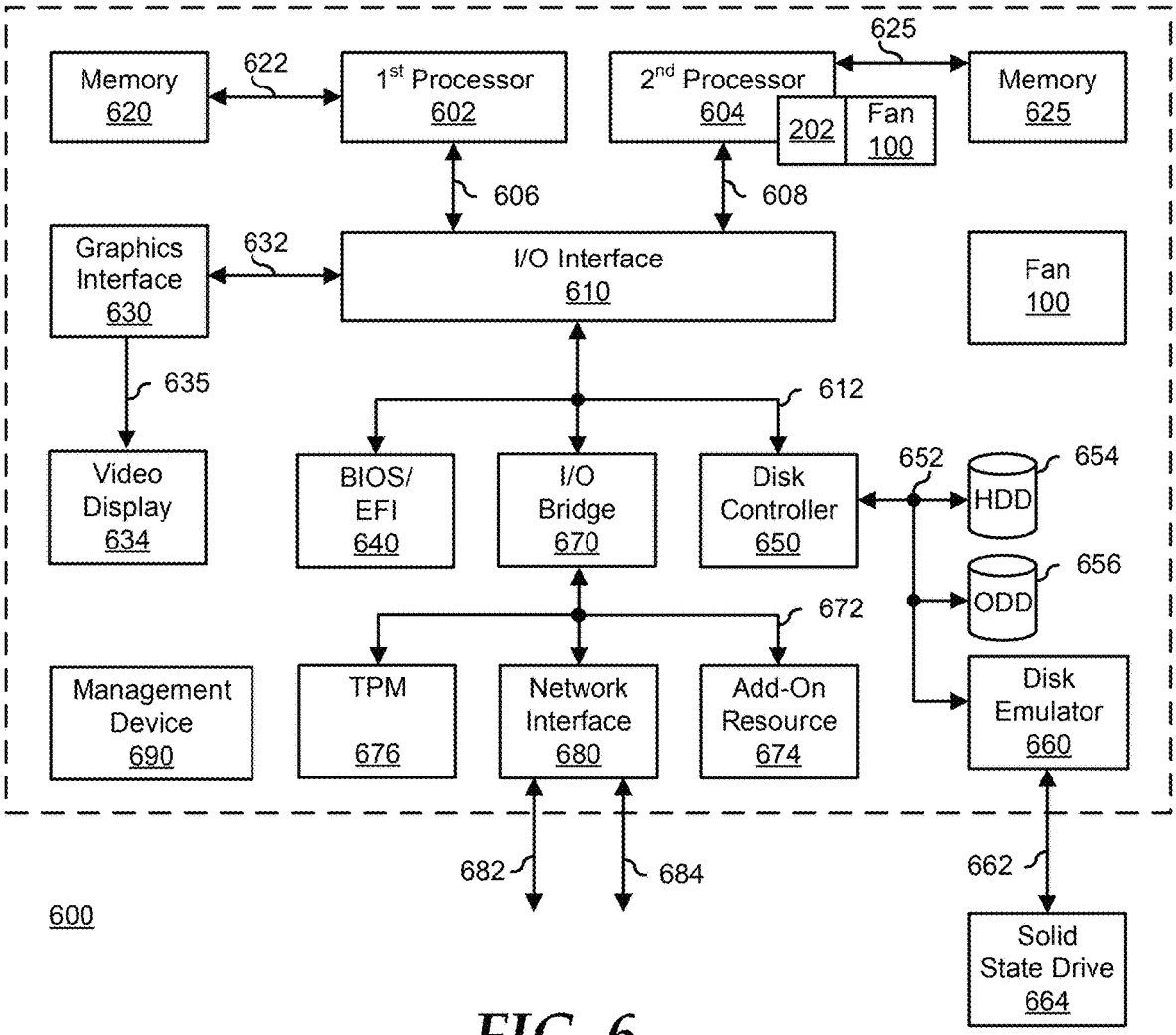
FIG. 6 is a block diagram of a general information handling system according to an embodiment of the present disclosure.

FIG. 6 shows a generalized embodiment of an information handling system 600 according to an embodiment of the present disclosure. For purpose of this disclosure an information handling system can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 600 can be a personal computer, a laptop computer, a smart phone, a tablet device or other consumer electronic device, a network server, a network storage device, a switch router or other network communication device, or any other suitable device and may vary in size, shape, performance, functionality, and price. Further, information handling system 600 can include processing resources for executing machine-executable code, such as a central processing unit (CPU), a programmable logic array (PLA), an embedded device such as a System-on-a-Chip (SoC), or other control logic hardware. Information handling system 600 can also include one or more computer-readable medium for storing machine-executable code, such as software or data. Additional components of information handling system 600 can include one or more storage devices that can store machine-executable code, one or more communications ports for communicating with external devices, and various input and output (I/O) devices, such as a keyboard, a mouse, and a video display. Information handling system 600 can also include one or more buses operable to transmit information between the various hardware components.

Information handling system 600 can include devices or modules that embody one or more of the devices or modules described below and operates to perform one or more of the methods described below. Information handling system 600 includes a processors 602 and 604, an input/output (I/O) interface 610, memories 620 and 625, a graphics interface 630, a basic input and output system/universal extensible firmware interface (BIOS/UEFI) module 640, a disk controller 650, a hard disk drive (HDD) 654, an optical disk drive (ODD) 656, a disk emulator 660 connected to an external solid state drive (SSD) 662, an I/O bridge 670, one or more add-on resources 674, a trusted platform module (TPM) 676, a network interface 680, a management device 690, and a power supply 695. Information handling system 600 includes multiple dual fan systems 100 of FIG. 1. In an example, one dual fan system 100 includes heat sink 202 and is in physical communication with processor 604. Another dual fan system 100 in located within the enclosure of information handling system 600 without necessarily being in physical communication with another component of the information handling system. Processors 602 and 604, I/O interface 610, memory 620, graphics interface 630, BIOS/UEFI module 640, disk controller 650, HDD 654, ODD 656, disk emulator 660, SSD 662, I/O bridge 670, add-on resources 674, TPM 676, and network interface 680 operate together to provide a host environment of information handling system 600 that operates to provide the data processing functionality of the information handling system. The host environment operates to execute machine-executable code, including platform BIOS/UEFI code, device firmware, operating system code, applications, programs, and the like, to perform the data processing tasks associated with information handling system 600.

In the host environment, processor 602 is connected to I/O interface 610 via processor interface 606, and processor 604 is connected to the I/O interface via processor interface 608. Memory 620 is connected to processor 602 via a memory interface 622. Memory 625 is connected to processor 604 via a memory interface 627. Graphics interface 630 is connected to I/O interface 610 via a graphics interface 632 and provides a video display output 636 to a video display 634. In a particular embodiment, information handling system 600 includes separate memories that are dedicated to each of processors 602 and 604 via separate memory interfaces. An example of memories 620 and 630 include random access memory (RAM) such as static RAM (SRAM), dynamic RAM (DRAM), non-volatile RAM (NV-RAM), or the like, read only memory (ROM), another type of memory, or a combination thereof.

BIOS/UEFI module 640, disk controller 650, and I/O bridge 670 are connected to I/O interface 610 via an I/O channel 612. An example of I/O channel 612 includes a Peripheral Component Interconnect (PCI) interface, a PCI-Extended (PCI-X) interface, a high-speed PCI-Express (PCIe) interface, another industry standard or proprietary communication interface, or a combination thereof. I/O interface 610 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. BIOS/UEFI module 640 includes BIOS/UEFI code operable to detect resources within information handling system 600, to provide drivers for the resources, initialize the resources, and access the resources. BIOS/UEFI module 640 includes code that operates to detect resources within information handling system 600, to provide drivers for the resources, to initialize the resources, and to access the resources.

Disk controller 650 includes a disk interface 652 that connects the disk controller to HDD 654, to ODD 656, and to disk emulator 660. An example of disk interface 652 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 660 permits SSD 664 to be connected to information handling system 600 via an external interface 662. An example of external interface 662 includes a USB interface, an IEEE 4394 (Firewire) interface, a proprietary interface, or a combination thereof. Alternatively, solid-state drive 664 can be disposed within information handling system 600.

I/O bridge 670 includes a peripheral interface 672 that connects the I/O bridge to add-on resource 674, to TPM 676, and to network interface 680. Peripheral interface 672 can be the same type of interface as I/O channel 612 or can be a different type of interface. As such, I/O bridge 670 extends the capacity of I/O channel 612 when peripheral interface 672 and the I/O channel are of the same type, and the I/O bridge translates information from a format suitable to the I/O channel to a format suitable to the peripheral channel 672 when they are of a different type. Add-on resource 674 can include a data storage system, an additional graphics interface, a network interface card (NIC), a sound/video processing card, another add-on resource, or a combination thereof. Add-on resource 674 can be on a main circuit board, on separate circuit board or add-in card disposed within information handling system 600, a device that is external to the information handling system, or a combination thereof.

Network interface 680 represents a NIC disposed within information handling system 600, on a main circuit board of the information handling system, integrated onto another component such as I/O interface 610, in another suitable location, or a combination thereof. Network interface device 680 includes network channels 682 and 684 that provide interfaces to devices that are external to information handling system 600. In a particular embodiment, network channels 682 and 684 are of a different type than peripheral channel 672 and network interface 680 translates information from a format suitable to the peripheral channel to a format suitable to external devices. An example of network channels 682 and 684 includes InfiniBand channels, Fibre Channel channels, Gigabit Ethernet channels, proprietary channel architectures, or a combination thereof. Network channels 682 and 684 can be connected to external network resources (not illustrated). The network resource can include another information handling system, a data storage system, another network, a grid management system, another suitable resource, or a combination thereof.

Management device 690 represents one or more processing devices, such as a dedicated baseboard management controller (BMC) System-on-a-Chip (SoC) device, one or more associated memory devices, one or more network interface devices, a complex programmable logic device (CPLD), and the like, which operate together to provide the management environment for information handling system 600. In particular, management device 690 is connected to various components of the host environment via various internal communication interfaces, such as a Low Pin Count (LPC) interface, an Inter-Integrated-Circuit ($I^2C$) interface, a PCIe interface, or the like, to provide an out-of-band (OOB) mechanism to retrieve information related to the operation of the host environment, to provide BIOS/UEFI or system firmware updates, to manage non-processing components of information handling system 600, such as system cooling fans and power supplies. Management device 690 can include a network connection to an external management system, and the management device can communicate with the management system to report status information for information handling system 600, to receive BIOS/UEFI or system firmware updates, or to perform other task for managing and controlling the operation of information handling system 600.

Management device 690 can operate off of a separate power plane from the components of the host environment so that the management device receives power to manage information handling system 600 when the information handling system is otherwise shut down. An example of management device 690 include a commercially available BMC product or other device that operates in accordance with an Intelligent Platform Management Initiative (IPMI) specification, a Web Services Management (WSMan) interface, a Redfish Application Programming Interface (API), another Distributed Management Task Force (DMTF), or other management standard, and can include an Integrated Dell Remote Access Controller (iDRAC), an Embedded Controller (EC), or the like. Management device 690 may further include associated memory devices, logic devices, security devices, or the like, as needed, or desired.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A dual fan system comprising:
a first fan to produce a first airflow;
a second fan to produce a second airflow;
an air duct in physical communication with both the first and second fans, the air duct including:
first and second nozzles;
a first channel in physical communication with an outlet of the first fan, wherein the first channel directs the first airflow into an area between the first and second nozzles;
a second channel in physical communication with an outlet of the second fan, wherein the second channel directs the second airflow into the area between the first and second nozzles, wherein the first and second airflows combine in the second nozzle to create an output airflow.

2. The dual fan system of claim 1, further comprising:
a first sloped section extending away from the exit of the first channel; and
a second sloped section extending away from the exit of the second channel, wherein the first and second sloped section direct the output airflow out of the dual fan system.

3. The dual fan system of claim 2, wherein the first sloped section includes a first opening at a neck of the second nozzle and the second sloped section includes a second opening at the neck of the second nozzle, wherein the first and second openings expose the first and second airflows to ambient air.

4. The dual fan system of claim 3, wherein a low-pressure region near the first opening pulls a third airflow into the air duct, and a second low pressure region near the second opening pulls a fourth airflow in the air duct.

5. The dual fan system of claim 4, wherein an addition of the third and fourth airflows increases an amount of airflow in the output airflow and decreases a pressure level of the output airflow.

6. The dual fan system of claim 1, further comprising a heat sink in physical communication with the air duct.

7. The dual fan system of claim 1, wherein a gap is located between the first and second fans, wherein the first and second airflows pull a third airflow from the gap into the air duct via the first nozzle.

8. The dual fan system of claim 7, wherein an addition of the third airflow increases an amount of airflow in the output airflow and decreases a pressure level of the output airflow.

9. The dual fan system of claim 1, wherein a neck of the second nozzle is at a same location as an exit of the first nozzle.

10. A dual fan system comprising:
a first fan to produce a first airflow;
a second fan to produce a second airflow;
an air duct in physical communication with the first and second fans, the air duct including:
first and second nozzles;
a first channel in physical communication with an outlet of the first fan, wherein the first channel directs the first airflow into an area between the first and second nozzles;
a second channel in physical communication with an outlet of the second fan, wherein the second channel directs the second airflow into the area between the first and second nozzles, wherein a gap is located between the first and second fans, wherein the first and second airflows pull a third airflow from the gap into the air duct via the first nozzle, wherein the first, second, and third airflows combine in the second nozzle to create an output airflow; and
a heat sink in physical communication with the air duct.

11. The dual fan system of claim 10, further comprising:

a first sloped section extending away from the exit of the first channel; and a second sloped section extending away from the exit of the second channel, wherein the first and second sloped section direct the output airflow out of the dual fan system.

12. The dual fan system of claim 11, wherein the first sloped section includes a first opening at a neck of the second nozzle and the second sloped section includes a second opening at the neck of the second nozzle, wherein the first and second openings expose the first and second airflows to ambient air.

13. The dual fan system of claim 12, wherein a low-pressure region near the first opening pulls a fourth airflow into the air duct, and a second low pressure region near the second opening pulls a fifth airflow in the air duct.

14. The dual fan system of claim 13, wherein an addition of the fourth and fifth airflows increases an amount of airflow in the output airflow and decreases a pressure level of the output airflow.

15. The dual fan system of claim 10, wherein an addition of the third airflow increases an amount of airflow in the output airflow and decreases a pressure level of the output airflow.

16. The dual fan system of claim 10, wherein a neck of the second nozzle is at a same location as an exit of the first nozzle.

17. An information handling system comprising:

a processor; and a dual fan system in physical communication with the processor, the dual fan system including:

a first fan to produce a first airflow;

a second fan to produce a second airflow;

an air duct in physical communication with both the first and second fans, the air duct including:

first and second nozzles;

a first channel in physical communication with an outlet of the first fan, wherein the first channel directs the first airflow into an area between the first and second nozzles;

a second channel in physical communication with an outlet of the second fan, wherein the second channel directs the second airflow into the area between the first and second nozzles, wherein the first and second airflows combine in the second nozzle to create an output airflow; and a heat sink in physical communication with the air duct and with the processor.

18. The information handling system of claim 17, wherein the dual fan system further includes:

a first sloped section extending away from the exit of the first channel; and a second sloped section extending away from the exit of the second channel, wherein the first and second sloped section direct the output airflow out of the dual fan system.

19. The information handling system of claim 18, wherein the first sloped section includes a first opening at a neck of the second nozzle and the second sloped section includes a second opening at the neck of the second nozzle, wherein the first and second openings expose the first and second airflows to ambient air.

20. The information handling system of claim 19, wherein a low-pressure region near the first opening pulls a third airflow into the air duct, and a second low pressure region near the second opening pulls a fourth airflow in the air duct.

* * * * *